US007441761B2

(12) United States Patent
Hughes

(10) Patent No.: US 7,441,761 B2
(45) Date of Patent: Oct. 28, 2008

(54) BAR CLAMP EXTENSION FIXTURE

(75) Inventor: David A. Hughes, Atlanta, GA (US)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 27 days.

(21) Appl. No.: 11/305,432

(22) Filed: Dec. 14, 2005

(65) Prior Publication Data

US 2007/0132165 A1 Jun. 14, 2007

(51) Int. Cl.
*B25B 1/02* (2006.01)

(52) U.S. Cl. ..... 269/147; 269/6; 269/149

(58) Field of Classification Search ..... 269/147, 269/143, 149, 91, 290, 296, 54.4, 54.5, 96, 269/6

See application file for complete search history.

(56) References Cited

U.S. PATENT DOCUMENTS 1,272,259 A * 7/1918 Herold ..... 269/149
1,354,378 A * 9/1920 Carpenter ..... 269/149
1,583,611 A * 5/1926 Seely ..... 269/149
3,172,158 A * 3/1965 Herman et al. ..... 269/143
6,530,565 B1 * 3/2003 Simpson ..... 269/6
2007/0057424 A1 * 3/2007 Kern ..... 269/6
2007/0090580 A1 * 4/2007 Fratianne ..... 269/6
2007/0114708 A1 * 5/2007 Springer ..... 269/6

* cited by examiner

*Primary Examiner*—Hadi Shakeri
(74) *Attorney, Agent, or Firm*—Lipsitz & McAllister, LLC

(57) ABSTRACT

An extension fixture for combining the clamping capacity of a first and a second bar I-beam cross section bar clamp. The first and second bar clamps each have a fixed jaw, a movable jaw, and a primary bar. The movable jaw of each bar clamp has a clamping means configured to provide a clamping force in the direction of the fixed jaw. To use the bar clamps with the extension fixture, the movable jaw is removed from the first bar clamp, and the movable jaw orientation on the second bar clamp is reversed so that the clamping means is then configured to provide a clamping force away form the second fixed jaw. The first and second primary bars are then inserted into the extension fixture, and pinned and clamped in position. The assembly then forms a combined capacity bar clamp.

8 Claims, 9 Drawing Sheets

-- Prior Art --

-- Prior Art --

-- Prior Art --

-- Prior Art --

-- Prior Art --

-- Prior Art --

BAR CLAMP EXTENSION FIXTURE

BACKGROUND OF THE INVENTION

1. Field of the Invention

The present invention generally relates to apparatuses and methods to extend the clamping capacity of bar clamps. More particularly, the present invention relates to an extension fixture to combine the clamping capacity of a pair of bar clamps.

2. Description of the Related Art

Bar clamps are commonly used in a variety of clamping situations where a clamping force needs to be applied to squeeze two surfaces together. With reference to the figures in which like numerals represent like elements throughout, FIG. 1 is a side perspective view of a commonly available bar clamp 10. A bar clamp 10 is typically comprised of a bar 30, with a fixed jaw 40 at one end, and a movable jaw 50 positioned on the bar. The movable jaw 50 may be slid along the bar 30 to vary the working capacity of the clamp 10. Both the fixed and movable jaws 30, 40 have parallel faces 42, 52 or clamping surfaces, for applying a clamping force to a work piece. The movable jaw 50 has a ratcheting or locking mechanism for restraining the movable jaw body at a position along the bar 30. The movable jaw 50 also has a clamping mechanism 56 for forcing the face 52 of the movable jaw 50 towards the fixed jaw face 42.

As shown in FIG. 2, a bar clamp 10 may be used to provide a clamping force across a single object 14, or multiple objects 14 positioned within the clamp. Bar clamps are especially useful in that they provide a clamping force between the two jaws 42, 52, with the jaws remaining substantially parallel to one another and perpendicular, or at ninety degrees to, the bar 30 as the clamping force is applied. The clamping force is depicted in FIG. 2 by arrows "A." Another useful feature of a bar clamp 10 is the straight reference edges the upper and lower edges 32, 34 of the bar 30 provides when clamping objects 14 together. For example as depicted in FIG. 2, multiple objects 14 may be positioned against the bar upper edge 32 and thus aligned with one another. To ensure the bar 30 remains straight under the clamping forces "A" the bar has a cross-sectional shape which is configured to resist bending. The straightness of the bar also ensures the fixed and movable jaw faces 42, 52 remain parallel as the clamping force is applied to the work piece.

As further shown in FIG. 2, a clamping force is applied to an object 14, or series of objects, by placing them within the bar clamp 10 between the fixed jaw 40 and the movable jaw 50. The movable jaw 50 is then moved along the bar 30 to initially position the objects 14 to be clamped adjacent the fixed jaw face 42 and movable jaw face 52. The clamping mechanism 56 is then actuated to provide a desired clamping force to squeeze the objects between the fixed jaw face 42 and movable jaw face 52. Typically the movable jaw 50 is readily reversible on the bar 30 with the fixed jaw 40 having a second outward face 44. When the movable jaw is reversed on the bar, the clamping mechanism 56 will force the movable jaw face 52 away from the fixed jaw outward face 44, and thus the bar clamp 10 may provide a spreading force between the fixed jaw outward face 44 and the movable jaw face 52. A bar clamp 10 typically has a hole 92 formed in the end of the bar 30 opposing the fixed jaw 40 which may be used to hang the clamp when stored.

A typical prior art clamping application in which bar clamps would be employed is the forming of a flat panel from multiple boards. As depicted in FIG. 3, a pair of bar clamps 10 may be positioned on a flat reference surface 16. The reference surface 16 then ensures that the upper edges 32 of the bars 30 are coplanar with one another. The upper edges 32 of bars 30 then present a substantially flat surface upon which multiple objects may be positioned to be clamped together. The surfaces of the objects adjacent the bar clamps 10 will then form a substantially flat or coplanar surface with one another. FIG. 3 shows two boards 14, depicted as transparent by dashed lines, being glued and clamped together by the bar clamps 10. In this manner, a flat panel such as a table top comprised of multiple boards 14 may be glued and clamped together while ensuring the surfaces of the boards 14 touching the upper edges 32 of the bar 30 are all substantially coplanar with one another. In this application, the straightness of each bar 30 under a clamping force, the parallel clamping action of the jaw faces 42, 52, and the jaw faces remaining perpendicular to the bar 30 are critical to ensure a completed panel with no bow or twist in the finished surface.

The clamping capacity of any bar clamp is limited by the length of the bar. The movable jaw may be positioned at the end of the bar away from the fixed jaw, which then forms the maximum distance between the fixed and movable jaw faces. This distance is typically referred to as the clamping capacity, or size, of the bar clamp. A craftsman will evaluate the clamping task at hand and selects an appropriate size bar clamp to embrace the work piece.

In practice, having only large capacity clamps is undesirable in that a clamp that is substantially longer than the work piece is ungainly in use. To allow for the efficient clamping various size objects, in a variety of clamping situations, a craftsman is then required to have several bar clamps of varying lengths. Moreover, the price of the bar clamps increases relative to the size of the clamp. The retail price of a bar clamp is proportional to the length of the clamp, with the larger higher capacity clamps being the most expensive. The greatest return for investment in the purchase of clamps is typically achieved by purchasing a series of short and intermediate length clamps to accommodate the bulk of clamping jobs at hand. When a task requires an especially large capacity clamp, a craftsman is forced to either purchase an expensive large capacity clamp, or find another means to clamp the work piece.

One example of a prior art bar clamp extension device is disclosed in U.S. Pat. No. 6,530,565, issued to Simpson. The Simpson extension device comprises an extension bar purchased separately from a bar clamp and a coupler used to join the extension bar to the bar of an existing clamp. In operation, the bar clamp requiring an extended capacity is modified by removing the fixed head from the clamp. The coupler is then used to join the bar of the bar clamp and the extension bar. The fixed head previously removed from the clamp is then placed on the opposing end of the extension bar from the coupler. A major disadvantage of the Simpson device is that it is designed for use on light duty bar clamps having a readily removable fixed head. The fixed head of the majority of heavy duty bar clamps on the market are not designed to be removable. The fixed head in heavy duty clamps is typically permanently secured to the bar by rivets or pins pressed into the assembly and is not designed to be removable by the craftsman in operation. For example, to remove the fixed head from the bar in a riveted design, the rivets must be drilled out of the head and bar. The rivets are thus destroyed in the removal process and must be replaced with another component upon reassembly. In a pin design, the pins must be forcibly driven from the head and bar and are not easily driven or forced back into position to reassemble the clamp. A few examples of such heavy duty clamp designs are marketed under the trade names; Bessey® K-body™, Gross Stabil® PC2™, Jorgenson® Cabinet Master™, and Jet® Parallel Clamps. Another major disadvantage of the Simpson device is that it is designed to extend the reach of light duty bar clamps having a bar of rectangular cross section. All the heavy duty bar clamps above have a bar which uses an I-beam cross section. The I-beam cross section efficiently maximizes the bending stiffness of the bar and is used in most heavy duty clamps.

According, it would be advantageous to provide a device and method to allow the accomplishment of large clamping jobs without the need for the purchase of large capacity heavy duty bar clamps. Such device and method would allow the use of a combination of small or medium capacity heavy duty bar clamps to accomplish a clamping task otherwise requiring a larger capacity clamp. The device and method should also preserve the advantages of bar clamps such as the straight reference edges provided by the bar and the parallel clamping action of the jaws of the clamp. It is thus to such a bar clamp extension device and method that the present invention is primarily directed.

SUMMARY OF THE INVENTION

The disadvantages of the prior art are overcome by the present invention which, in one aspect, is an extension fixture for combining the clamping capacity of a first and a second bar clamp. The first and second bar clamps each have a fixed jaw, a movable jaw, and a primary bar. Each movable jaw has a clamping means configured to provide a clamping force in the direction of the fixed jaw. Each primary bar has an upper edge, a lower edge, a first distal end, a second distal end, and an I-beam cross sectional shape. Each fixed jaw is affixed to the primary bar at the first distal end. To prepare the bar clamps for use with the extension fixture, the movable jaw is removed from the first bar clamp, and the movable jaw orientation on the second bar clamp is reversed so that the clamping means is then configured to provide a clamping force away form the second fixed jaw.

The extension fixture comprises a fixture body having a first end, a second end, an upper surface, a lower surface, a first side, and a second side. The fixture body further comprises a channel in the upper surface thereof, with the channel extending from the fixture first end to the fixture second end. The channel also has a complimentary cross sectional shape for receiving the first and the second primary bar cross section therein. The extension fixture also comprises a first pin means for pinning the second distal end of the first primary bar within the fixture body, and a second pin means for pinning the second distal end of the second primary bar within the fixture body. The extension fixture also comprises a clamping means for clamping the first and second primary bars within the fixture body. Wherein the first and second primary bars are inserted into the fixture body, and the pin means and the clamping means are applied, the first and second pin means supports the clamping force between the fixed jaw of the first bar clamp and the movable jaw of the second bar clamp, and wherein the clamping means holds the first primary bar and the second primary bar in substantially parallel alignment.

In another aspect of the present invention, the channel in the fixture body has a first interior side surface, a second interior side surface, and a bottom surface. The complimentary cross sectional shape of the fixture body has at least one hinge portion proximate to the channel bottom surface. Wherein as the clamping means is applied to the fixture body, the first interior side surface is biased towards the second interior side surface clamping the first and second primary bars within the fixture body. The deflection of the fixture body complimentary cross sectional shape occurs primarily in the at least one hinge portion. In another aspect of the present invention, the camping means is a threaded connector inserted through the fixture body and tightened.

In yet another aspect of the present invention, both the first and the second primary bars have a hole passing thru the primary bar proximate to the second distal end. The extension fixture further comprises a first hole passing through the fixture body proximate to the fixture body first end, the first hole extending from the channel to at least one of the fixture body first side or the fixture body second side, and second hole passing through the fixture body proximate to the fixture body second end, the second hole extending from the channel to at least one of the fixture body first side or the fixture body second. Wherein the first pin means is a pin passing through the first hole in the fixture body and through the hole in the first primary bar. The second pin means is a pin passing through the second hole in the fixture body and through the hole in the second primary bar.

In yet another aspect of the present invention, the primary bar has a first side, a second side, and a cross sectional shape. The cross sectional shape has a first concave portion between the upper edge and the lower edge on the first side of the primary bar, and an opposing second concave portion between the upper edge and the lower edge on the second side of the primary bar. The extension fixture further comprises the complimentary cross sectional shape of the channel in the fixture body has a complimentary first convex portion, and an opposing complimentary second convex portion. Wherein when a first and a second primary bar are positioned within the channel and the clamping means is applied to the fixture body, the first convex portion of the fixture body is received in the first concave portion of each primary bar, the second convex portion of the fixture body is received in the second concave portion of each primary bar, and the first primary bar, the second primary bar, and the extension fixture are clamped in substantially parallel alignment. In yet another aspect of the present invention, the upper edge of each primary bar extends above the upper surface of the fixture body when the primary bars are clamped within the fixture body.

In yet another aspect of the present invention, the bar clamp fixed jaw further comprises a lower surface configured to support the primary bar upper edge an offset distance from a reference surface, and the bar clamp movable jaw further comprises a lower surface configured to support the primary bar upper edge the offset distance from the reference surface. Wherein the channel in the fixture body is displaced from the lower surface of the fixture body such that when the primary bar is clamped within the fixture body, and the lower surface of the fixed jaw and the lower surface of the movable jaw are placed on a reference surface, the primary bar upper edge is supported at substantially the same offset distance from the reference surface at both the fixed jaw and the movable jaw locations. The fixture body lower surface being positioned either above the reference surface or adjacent the reference surface, and the primary bar upper edge then being substantially parallel to the reference surface.

The invention further provides a method of combining the clamping capacity of a first and a second bar clamp. The first and second bar clamps each have a fixed jaw, a movable jaw, and a primary bar. Each movable jaw has a clamping means configured to provide a clamping force in the direction of the fixed jaw. Each primary bar has an upper edge, a lower edge, a first distal end, a second distal end, and an I-beam cross sectional shape with each fixed jaw being affixed to the primary bar at the first distal end.

The method comprising the steps of removing the movable jaw from the first bar clamp. Reversing the movable jaw on the second bar clamp such that the clamping means of the movable jaw is now configured to provide a clamping action away from the fixed jaw. Obtaining an extension fixture comprising a fixture body having a first end, a second end, an upper surface, a lower surface, a first side, and a second side. The extension fixture further comprising a channel in the upper surface of the fixture body with the channel extending from the fixture first end to the fixture second end. The channel also having a complimentary cross sectional shape for receiving the first and the second primary bar cross section therein.

Positioning the second distal end of the first primary bar within the channel of the fixture body proximate to the fixture body first end. Applying a first pin means for pinning the first primary bar within the fixture body. Positioning the second distal end of the second primary bar within the channel of the fixture body proximate to the fixture body second end. Applying a second pin means for pinning the second primary bar within the fixture body. Applying a clamping means for clamping the first and second primary bars within the fixture body. Wherein the pin means supports the clamping force between the fixed jaw of the first bar clamp and the movable jaw of the second bar clamp, and wherein the clamping means holds the first primary bar and the second primary bar in substantially parallel alignment.

In another aspect of the present invention, the channel in the fixture body has a first interior side surface, a second interior side surface, and a bottom surface, and the complimentary cross sectional shape of the fixture body has at least one hinge portion proximate to the channel bottom surface. The step of applying a clamping means preferably includes the step of applying a clamping means to the fixture body. The first interior side surface being biased towards the second interior side surface clamping the first and second primary bars within the fixture body. The deflection of the fixture body complimentary cross sectional shape occurring primarily in the at least one hinge portion. In another aspect of the present invention, the step of applying a clamping means preferably include the step of applying and tightening a threaded connector through the fixture body.

In yet another aspect of the present invention, both the first and the second primary bars have a hole passing thru the primary bar proximate to the second distal end. The step of applying a first pin means preferably includes a first hole passing through the fixture body proximate to the fixture body first end, the first hole extending from the channel to at least one of the fixture body first side or the fixture body second side, and a pin being positioned through the first hole in the fixture body and through the hole in the first primary bar. And the step of applying a second pin means preferably includes a second hole passing through the fixture body proximate to the fixture body second end, the second hole extending from the channel to at least one of the fixture body first side or the fixture body second side, and a pin is positioned through the second hole in the fixture body and through the hole in the second primary bar.

In yet another aspect of the present invention, the primary bar has a first side, and a second side. The primary bar also has a cross sectional shape with a first concave portion between the upper edge and the lower edge on the first side of the primary bar, and an opposing second concave portion between the upper edge and the lower edge on the second side of the primary bar. The complimentary cross sectional shape of the channel in the fixture body has a complimentary first convex portion, and an opposing complimentary second convex portion. And the steps of positioning the first and a second primary bars within the channel and applying the clamping means to the fixture body, preferably includes the steps of the first convex portion of the fixture body being received in the first concave portion of each primary bar, the second convex portion of the fixture body being received in the second concave portion of each primary bar, and the first primary bar, the second primary bar, and the extension fixture being clamped in substantially parallel alignment.

In yet another aspect of the present invention, the bar clamp fixed jaw further comprises a lower surface configured to support the primary bar upper edge an offset distance from a reference surface, and the bar clamp movable jaw further comprises a lower surface configured to support the primary bar upper edge the offset distance from the reference surface. And wherein the step of applying a clamping means for clamping the first and second primary bars within the fixture body preferably includes the step of placing the lower surface of the movable jaw and the lower surface of each fixed jaw on a reference surface, the first and second primary bars upper edges then being supported at substantially the same offset distance from the reference surface at both the fixed jaw locations and the movable jaw location, and being substantially parallel to the reference surface. And the steps of positioning the second distal end of the first and second primary bars within the channel of the fixture body proximate to the fixture body first and second ends preferably includes the channel in the fixture body being displaced from the lower surface of the fixture body such that the fixture body lower surface is positioned either above the reference surface or adjacent the reference surface.

In yet another aspect of the present invention, the step of positioning the second distal end of the first primary bar within the channel of the fixture body proximate to the fixture body first end preferably includes the upper edge of the first primary bar extending above the upper surface of the fixture body. The step of positioning the second distal end of the second primary bar within the channel of the fixture body proximate to the fixture body second end preferably includes the upper edge of the second primary bar extending above the upper surface of the fixture body.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The bar clamp extension fixture and method provides a way to combine the clamping capacity of two bar clamps. The fixture allows joining the bars of each bar clamp end to end to effectively form one longer combined clamp. The fixture is easily used with a pair of bar clamps, will not allow a significant defection of the bars of the clamps when under a clamping force, nor will the fixture interfere with a work piece laid across the tops of the combined bars.

Figure 3:
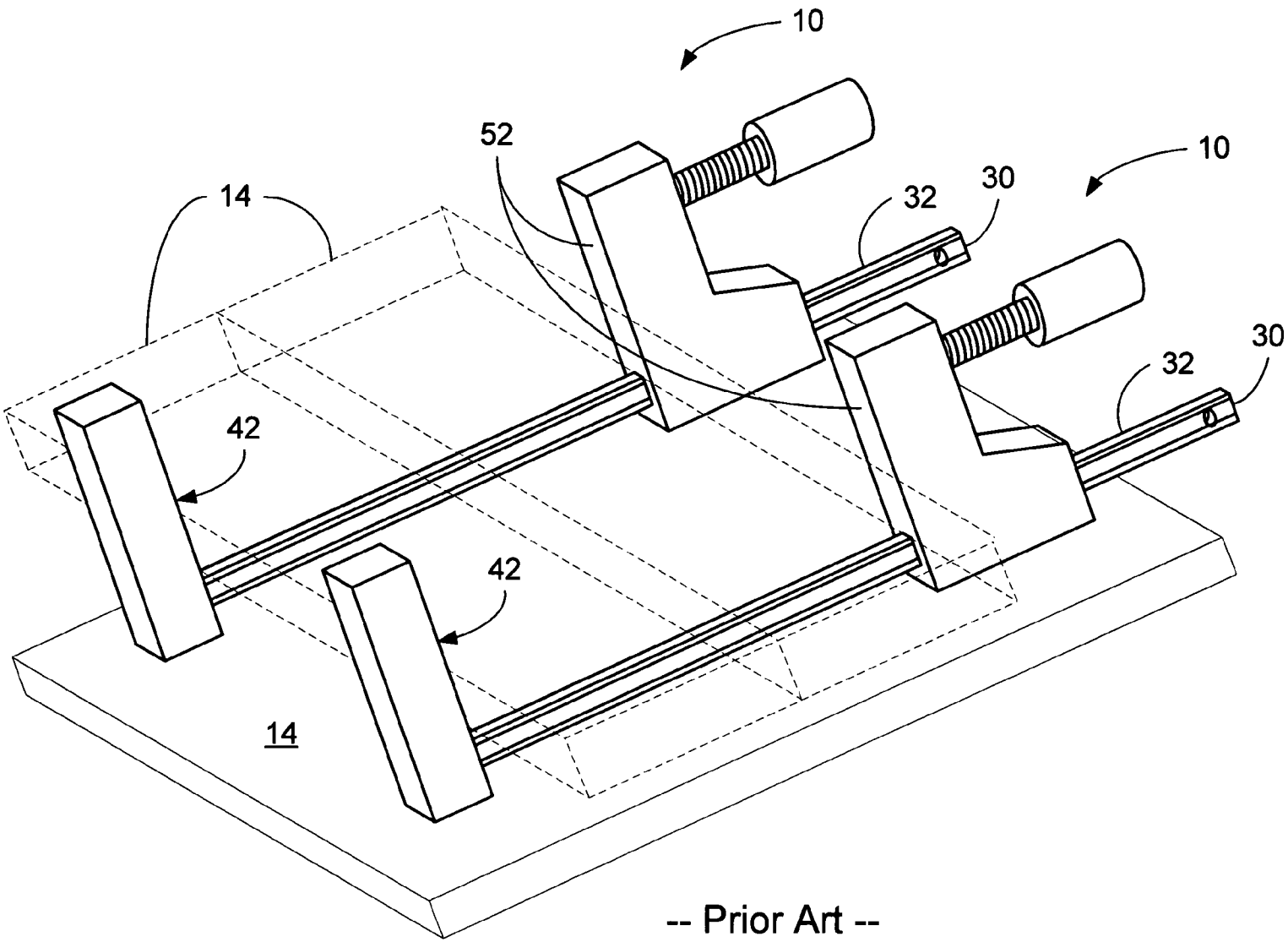
FIG. 3 is a side-perspective view of a pair of prior art bar clamps, illustrating the clamping of a flat panel by using the prior art bar clamps on a reference surface.

FIG. 3 is a cross-section view through the bar of a typical heavy duty bar clamp. The bar is typically made from a steel or steel allow extrusion and is configured to minimize bending when a clamping force is applied by the jaws of the bar clamp. The cross section of the bar 30 typically has a full section width at the top edge 32 and the bottom edge 34 between the side surfaces 36 and a more narrow middle portion 37 between the upper and lower edges. The bar 30 typically has concave or inwardly curving surfaces 38 on each side, resulting in the narrow cross section in the middle portion 37. This cross sectional configuration is an efficient use of material to resist bending and is similar in design and function to the cross-section of a common I-beam. The bar of a heavy duty bar clamp which has a cross sectional shape having a first similar section width at the top edge and the bottom edged, and having a second more narrow width center section between the top edge and the bottom edge, is defined herein as having an "I-beam" cross section. The I-beam cross section of the bar may have various shapes depending upon the brand of the bar clamp, but all have an inwardly curving, or concave portion in the middle. As may be appreciated by one skilled in the art, the concave surfaces 38 may be circular, parabolic, or may be comprised of short straight segments, or any combination thereof.

Figure 5:
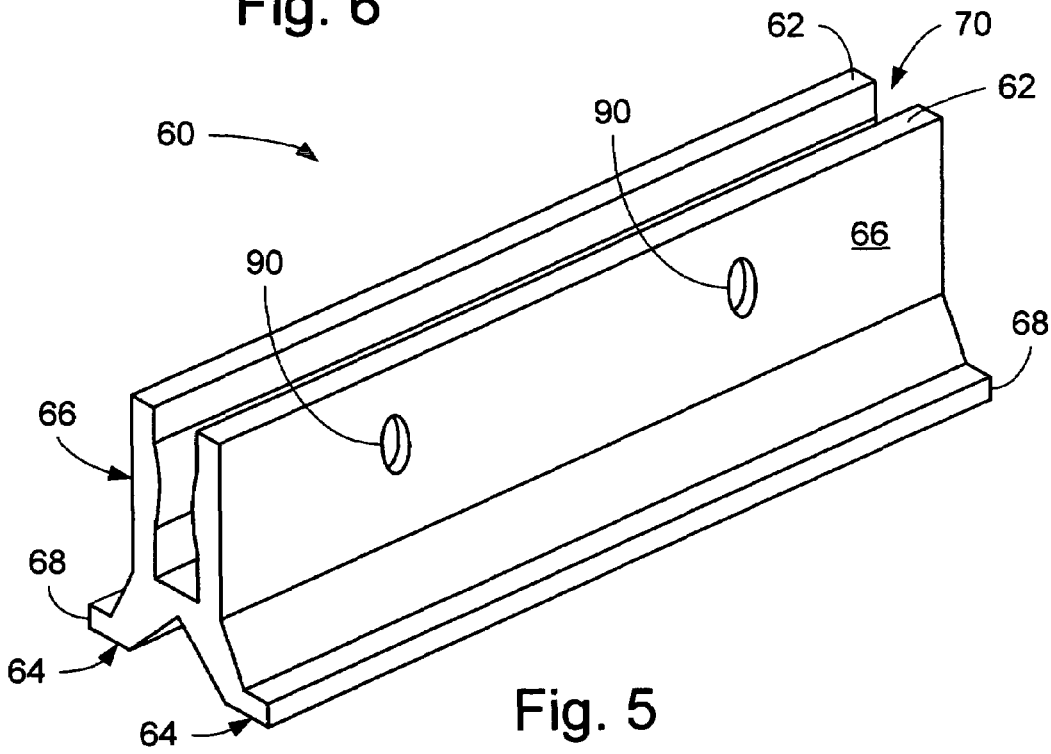
FIG. 5 is a side-perspective view of the bar clamp extension fixture.

A side perspective view of one embodiment of the bar clamp extension fixture is depicted in FIG. 5. The extension fixture has upper surfaces 62, bottom surfaces 64, and side surfaces 66. Leg portions 68 extend from each side surface 66 and result in the fixture having a wide and stable base. A channel 70 extends into to the top of the extension fixture 60 and is configured to receive the end of a bar 30 from a bar clamp 10. Openings 90 are formed in the body of the extension fixture 60 and extend form one side surface 66 through the fixture to the opposing side surface 66.

Figure 6:
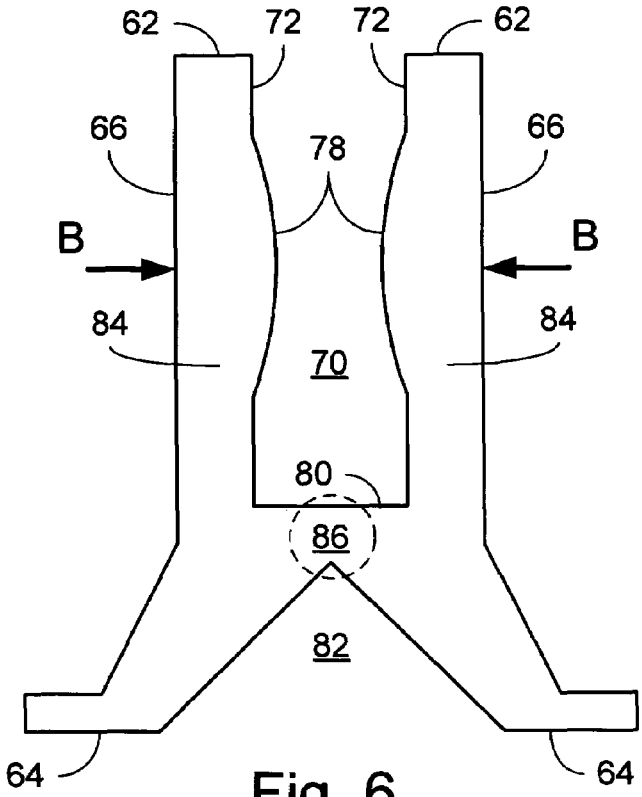
FIG. 6 is a front cross-sectional view through the body of the bar clamp extension fixture of FIG. 5.
Figure 4:
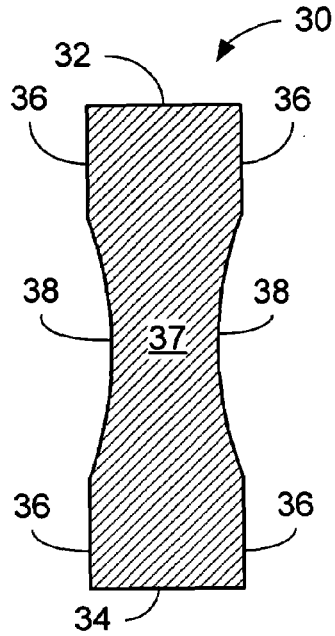
FIG. 4 is a front cross-sectional view through the bar of a prior art bar clamp.

The cross-section of the bar clamp extension fixture 60 is shown in FIG. 6. The extension fixture 60 has a channel 70 extending into the top surface 62 between the side walls 84. The cross-sectional shape of the channel 70 closely matches the cross-sectional shape of the bar 30 as depicted in FIG. 4. The inside surfaces 72 of the channel 70 have convex or outwardly curving surfaces 78. The cross-section width of the extension fixture 60 at the convex surfaces 78 is more narrow than the width of the upper or lower portions of the bar 30 cross-section as depicted in FIG. 4, and the bar may only be inserted axially into the end of the fixture. The channel 70 cross-section is slightly wider at side surfaces 72 than that of the bar 30 at side surfaces 36 to allow for the free insertion of the bar 30 axially into the end of the extension fixture 60. The convex surfaces 78 of the extension fixture 60 are configured to closely engage concave surfaces 38 of the bar 30. As may be appreciated by one skilled in the art, the convex surfaces 78 may be comprised of circular segments, parabolic segments, or straight segments, or any combination thereof.

As further depicted in FIG. 6, the extension fixture 60 cross-section has a bottom surface 80 and a triangular recess 82 in the bottom edge 64. The triangular recess 82 thins the cross section of the extension fixture 60 adjacent the channel 70 bottom surface 80 and results in a relatively compliant hinge portion 86, depicted in FIG. 6 by a dashed circle, between the bottom surface 80 and triangular recess 82. As a clamping force is applied across the extension fixture 60 in the direction of arrows "B," the side walls 84 of the extension fixture will rotate inwardly narrowing the width of the channel 70, with the deflection of the cross section substantially occurring within the hinge portion 86.

Figure 7A:
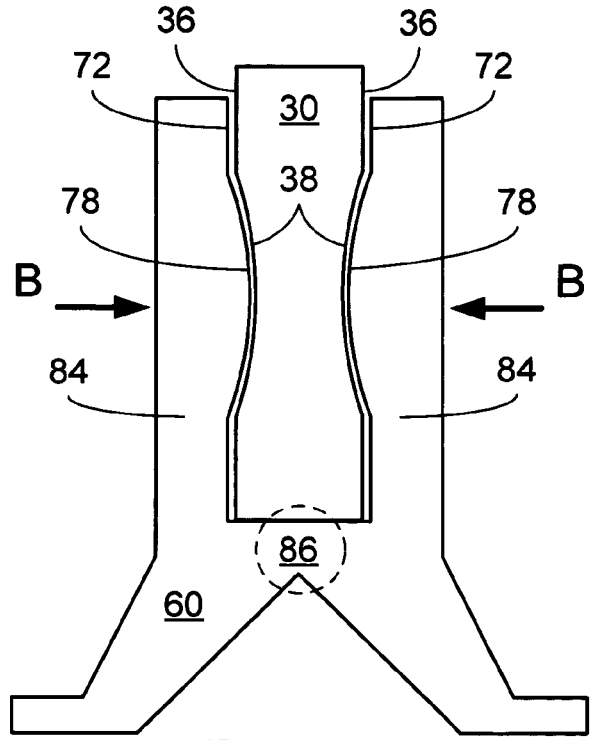
FIGS. 7A and 7B are cross-sectional views of the bar clamp extension fixture of FIG. 6, with the prior art bar clamp of FIG. 4 inserted within.

As depicted in FIG. 7A, when a bar 30 is inserted into the extension fixture 60, and a clamping force is applied in the direction of arrows "B" the side walls 84 rotate inward and convex surfaces 78 are forced into contact with the concave surfaces 38 of the inserted bar 30. The cross-sectional shape of the extension fixture 60 is configured such that under a clamping force, the convex surfaces 78 of the extension fixture contacts the concave surfaces 38 of the bar 30 substantially before the side walls 72 of the extension fixture contact the side walls 36 of the bar. The two surfaces 78, 38 are then pressed into axial alignment with one another along the length of the extension fixture 60. The curved surfaces 78, 38 being forced together by the clamping force along the length of the extension fixture 60 results in a consistent and repeatable parallel alignment of the extension fixture with the inserted bar 30, with a high resistance to any relative movement of the components due to bending forces across the interface. In this manner, when the bar 30 is clamped within the extension fixture 60, the components are effectively locked in alignment with a bending stiffness across the joint comparing favorably with that of a continuous bar 30. The use of the hinge portion 86 in the extension fixture 60 allows the controlled deflection of the fixture cross section primarily within the hinge portion, while substantially maintaining the cross-sectional shape of side walls 84 and convex surfaces 78. The inclusion of the hinge portion 86 in the body of the extension fixture 60 allows for a single component design which is readily manufactured. As will be appreciate by one skilled in the art, in an alternative embodiment the extension fixture 60 may be fabricated in two pieces, with each piece comprising side walls 84 with convex surface 78. In another alternative embodiment, the hinge portion 86 of the extension fixture 60 may be replaced with a mechanical hinge as are readily known to one skilled the art.

Figure 7B:
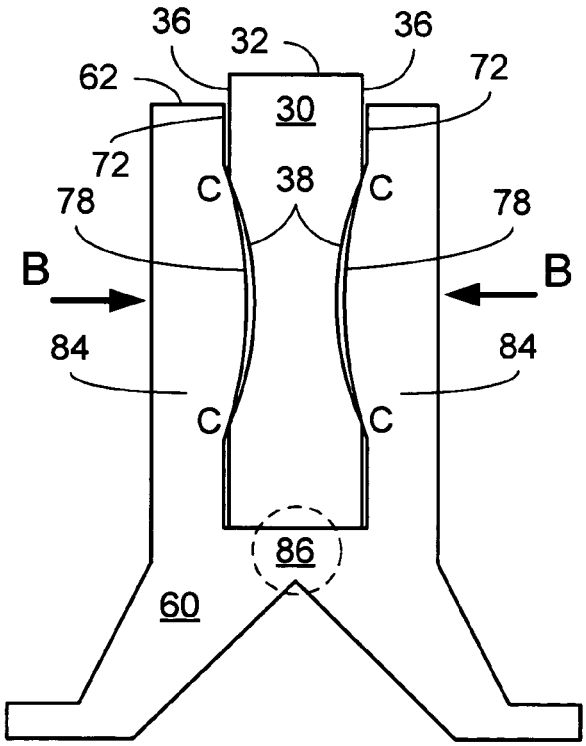

As depicted in FIG. 7B, in another alternative embodiment of the present invention, the effective radius of the convex curved surfaces 78 of the side walls 84 is larger than the radius of curvature of the concave curved surfaces 38 of the bar 30. As a clamping force is applied in the direction of arrows "B" and the side walls 84 rotate inward, and the convex surfaces 78 of the extension fixture 60 will contact the concave surfaces 38 of the bar 30 thus clamping the bar within the extension fixture. When the convex surface 78 is forced into the concave surface 38 having a slightly smaller radius, the two surfaces will touch substantially along a first line of contact at the top and a second line of contact at the bottom of each convex surface 78 and concave surface 38 pair. The points of contact are marked by points "C" in FIG. 7A. Stated another way, the large radius of the convex surface 78 will be forced into the smaller radius of the concave surface 38, and the convex surface 78 will wedge into the concave surface 38. The two surfaces are then wedged into axial alignment with one another along the length of the lines of contact along the extension fixture 60. The wedging together of the curved surfaces 78, 38 under the clamping force again results in a consistent and repeatable parallel alignment of the extension fixture 60 with an inserted bar 30 with a high resistance to any relative movement of the components due to bending forces across the interface.

Figure 1:
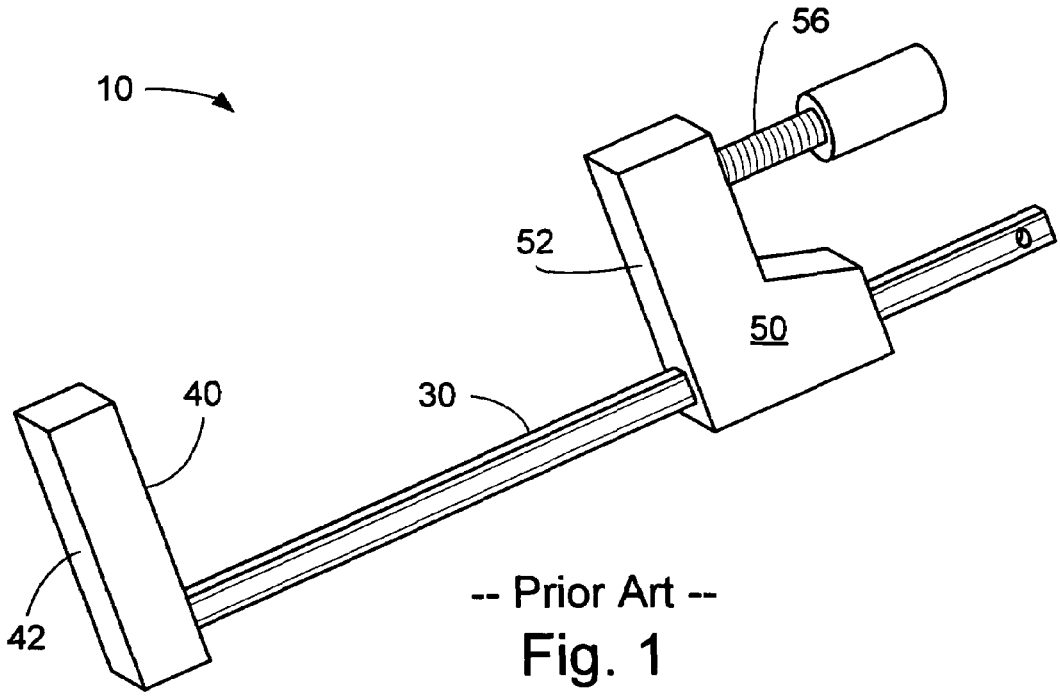
FIG. 1 is a side-perspective view of a prior art bar clamp comprising a bar, a fixed jaw, and a movable jaw.
Figure 2:
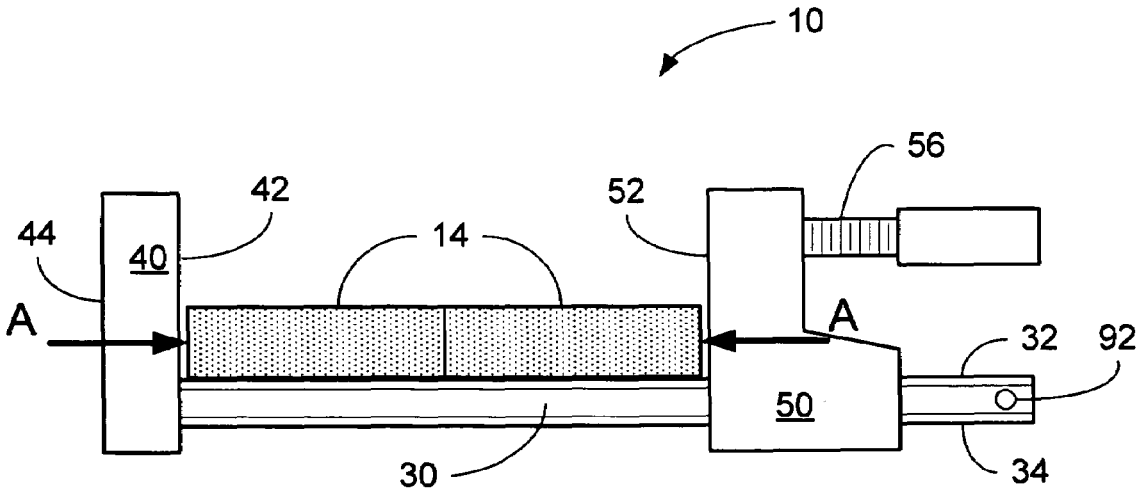
FIG. 2 is a side view of a prior art bar clamp, illustrating applying a clamping force to a pair of objects placed between the fixed and movable jaws.

As further shown in FIGS. 7A and 7B, when the bar 30 is clamped in position in the extension fixture 60, the upper edge 32 of the bar projects above the upper surface 62 of the extension fixture. As in the prior art bar clamp of FIGS. 2 and 3, the extension fixture 60 will not interfere with objects positioned upon or adjacent the bar 30 for clamping. In alternative embodiments of the invention of FIG. 7A and 7B, the cross-sectional shape of convex curved surface 78 may be comprised of straight segments thus forming flat facets in the convex curved surface 78. As will be appreciated by one skilled in the art, the flat facets will also wedge into the concave surface 38 of the bar 30 and lock the bar in alignment with the extension fixture 60. In one embodiment the bar clamp extension fixture 60 is made of an aluminum extrusion. As may be appreciated by one skilled in the art, in alternative embodiments the extrusion fixture may also be formed from steel, steel alloys, reinforced plastic, or other material having the required stiffness, strength and flexibility.

Figure 8A:
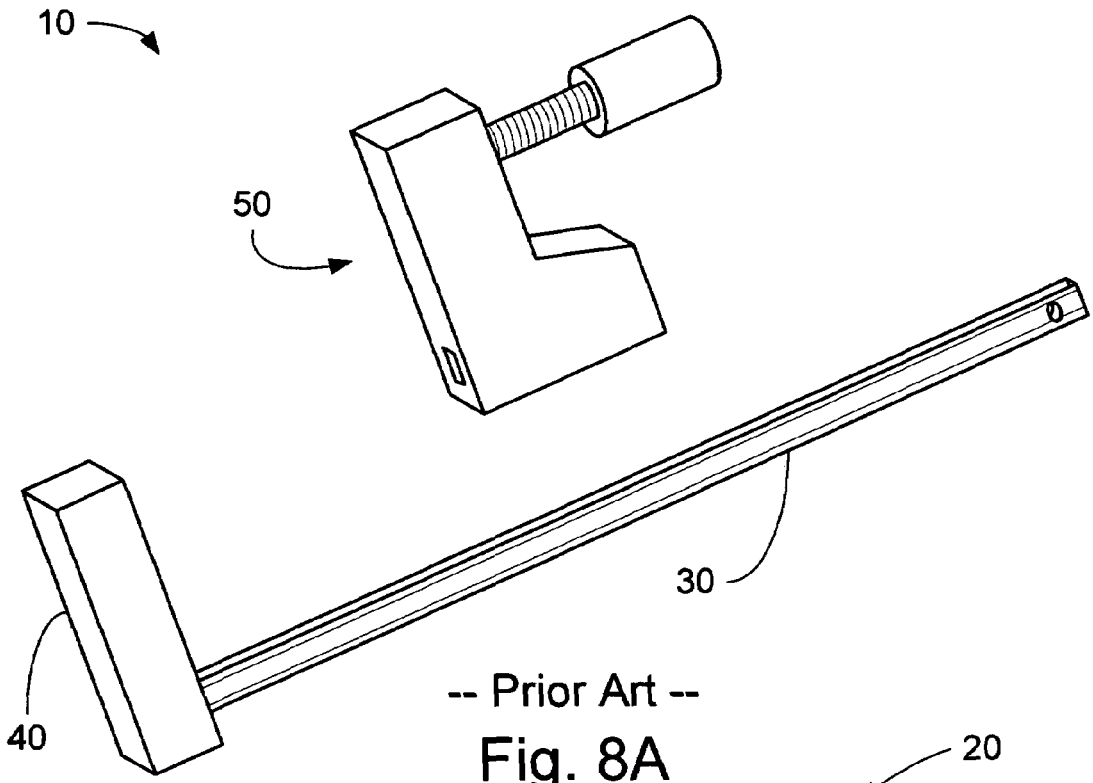
FIG. 8A is a prior art bar clamp of FIG. 1, with the movable jaw removed from the bar.
Figure 8B:
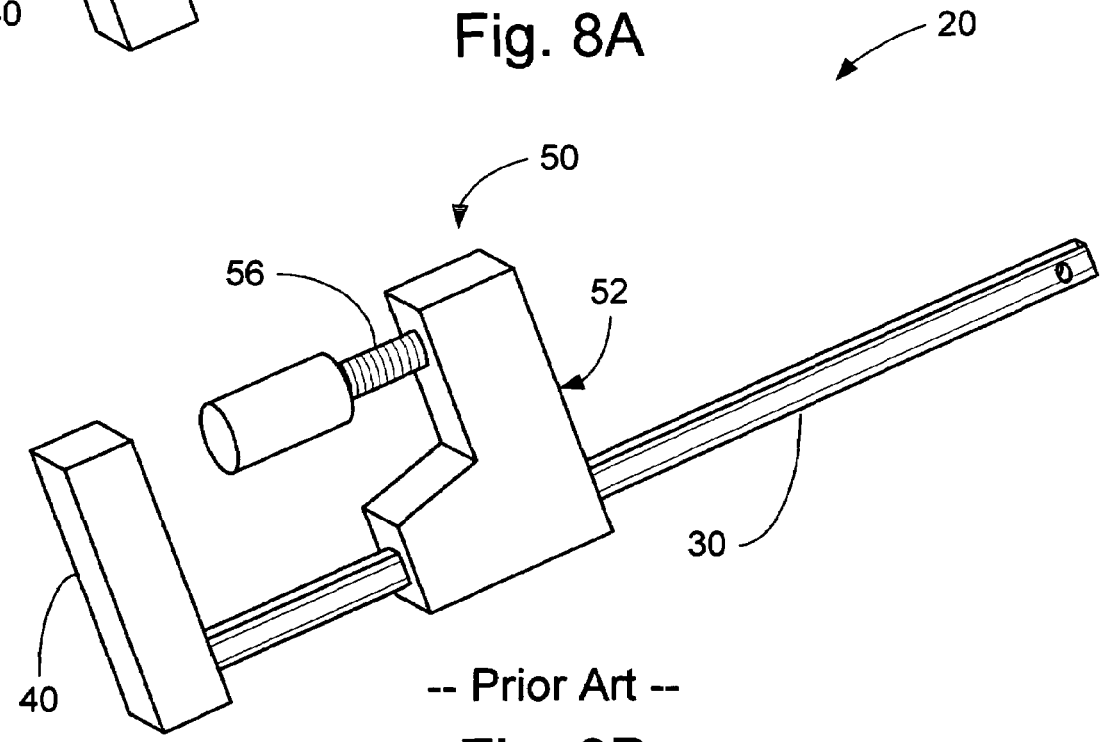
FIG. 8B is a prior art bar clamp of FIG. 1, with the orientation of the movable jaw reversed on the bar.

As depicted in FIG. 8A, the movable jaw 50 of a first bar clamp 10 may be readily removed from the bar 30. The remaining bar 30 with fixed jaw 40 of the first bar clamp 10 is then ready for insertion in the extension fixture. As depicted in FIG. 8B, the movable jaw 50 of a second bar clamp 20 may be removed from the bar 30 and placed back onto the bar facing in the opposite direction. In this position, the clamping mechanism 56 of the movable jaw 50 is configured to force the movable jaw face 52 away from the fixed jaw 40. This configuration is the same as that required when the bar clamp 20 is used to provide a spreading force between the fixed jaw 40 and movable jaw 50, and the prior art heavy duty bar clamps are designed to be readily configured in this manner. The ends of two bars 30 may now be inserted into opposing ends of the extension fixture and clamped in position and alignment. The first and second bar clamps 10, 20 will then effectively form one long combined bar clamp.

Figure 9:
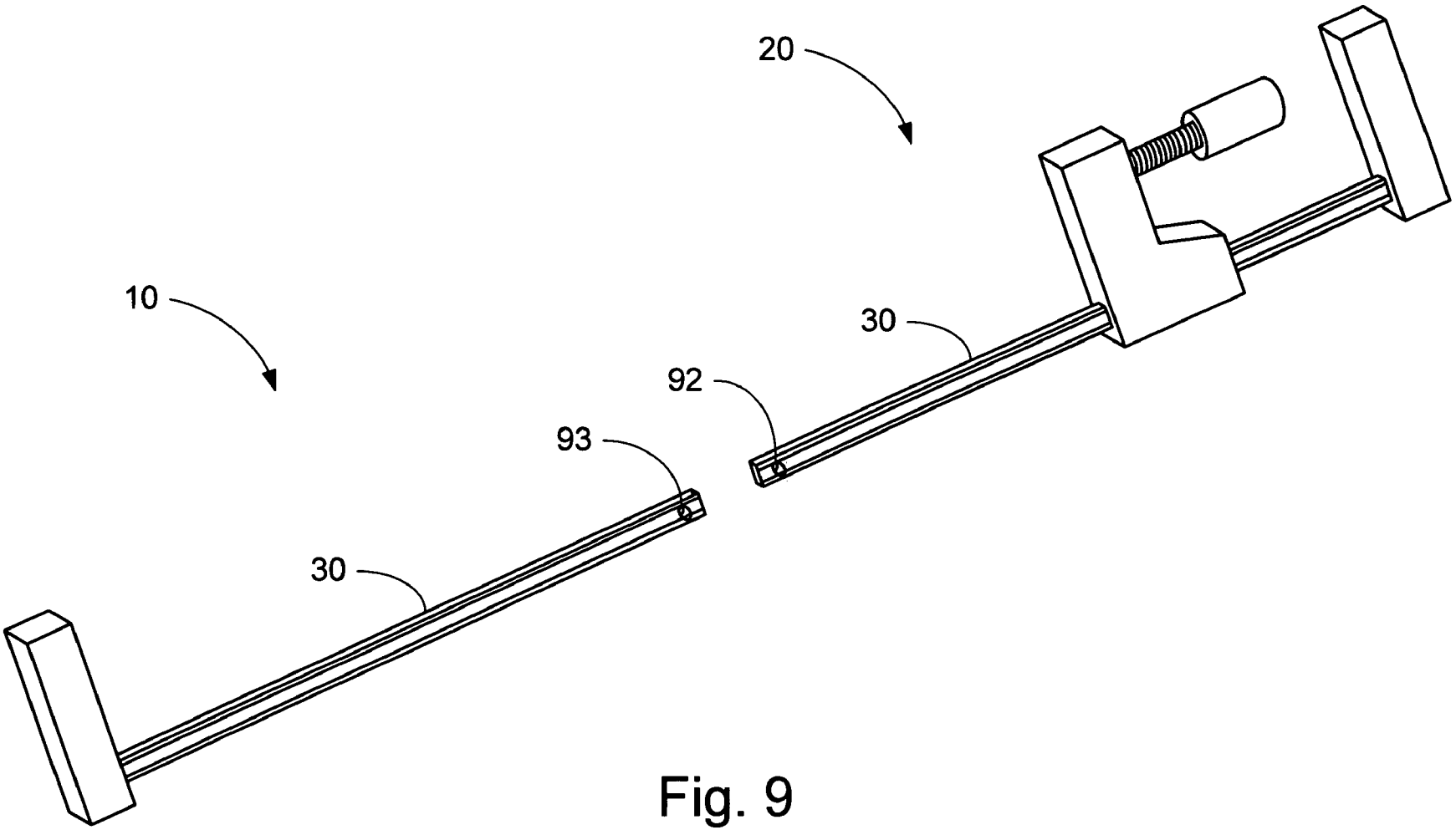
FIG. 9 depicts the prior art bar clamps of FIG. 8A and FIG. 8B positioned aligned with one another.
Figure 10:
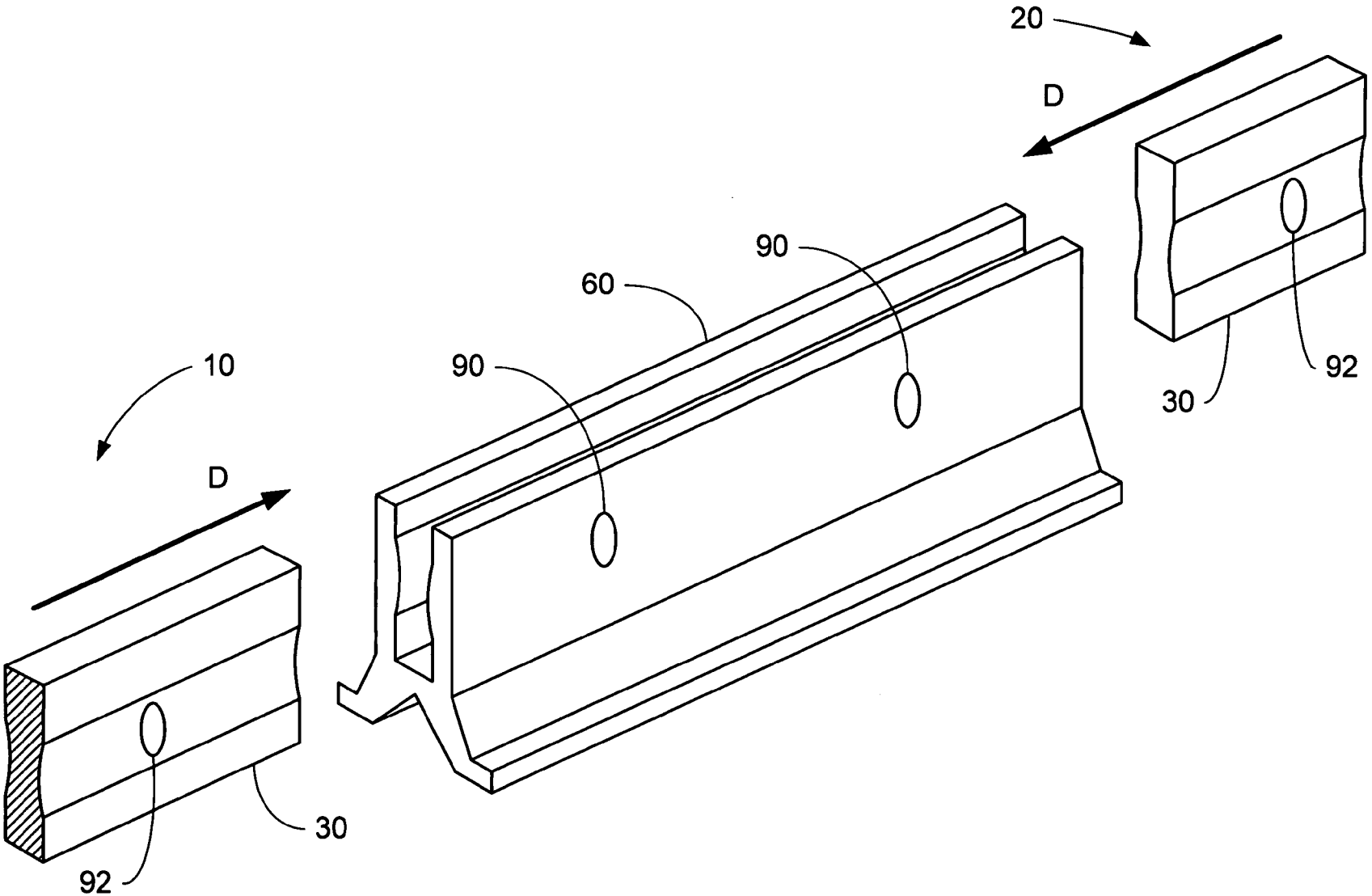
FIG. 10 depicts the prior art bar clamps of FIG. 8A and FIG. 8B being inserted into the bar clamp extension fixture of FIG. 5.
Figure 11:
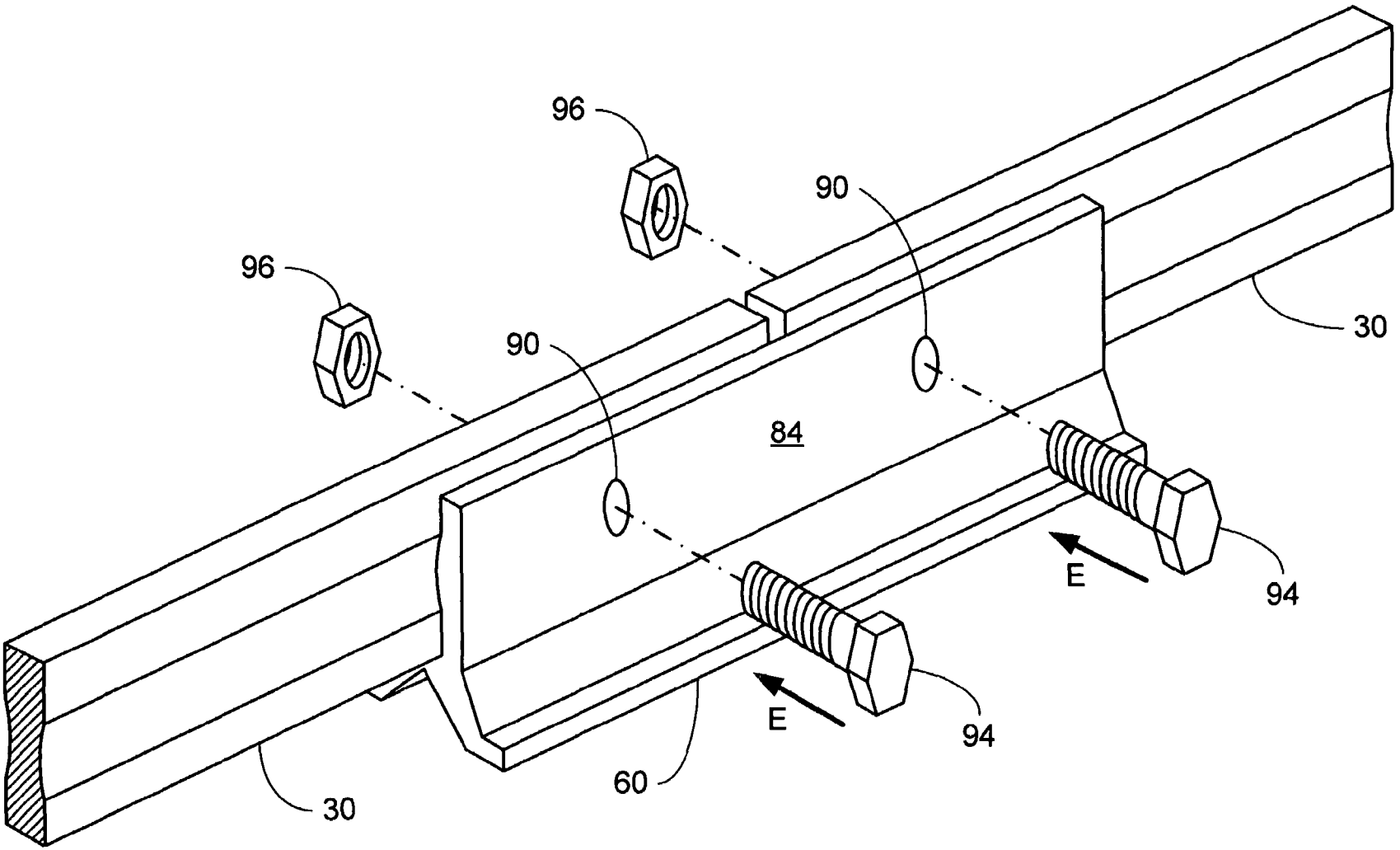
FIG. 11 depicts the prior art bar clamps of FIG. 8A and FIG. 8B being pinned and clamped by fasteners into the bar clamp extension fixture of FIG. 5.

As shown in FIGS. 9-11, the first bar clamp 10, second bar clamp 20, and the extension fixture 60 are now be assembled to form the combined capacity bar clamp assembly 100. As depicted in FIG. 9, the first bar clamp 10 and the second bar clamp 20 are positioned with the ends of the bars 30 opposing each other and the fixed jaws of each clamp oriented in the same direction. A hole 92 is commonly present in the ends of bars 30. If the hole 92 is not present in the particular brand of bar clamp being used, the hole must be formed in the bar 30 by drilling or other means as are readily know to those skilled in the art. If drilling is required, the extension fixture 60 may be placed on the bar 30 and used as a guide in positioning the hole 92.

As depicted in FIG. 10, the ends of each bar 30 of the first and second bar clamps 10, 20 may then be inserted into the extension fixture 60 in the direction of arrows "D" from opposing ends of the fixture. As depicted in FIG. 11, the bars 30 may be pinned in the extension fixture 60 by inserting bolts 94 in the direction of arrows "E" with the bolts passing through holes 90 in the fixture and holes 92 in the ends of each bar 30. Nuts 96 are then installed on the protruding ends of bolts 94 and tightened to provide a clamping force to the assembly. The bolts 94 and nuts 96 provide a ready means to generate a high clamping force across the extension fixture 60 and firmly clamp the bars 30 within the extension fixture. The bolts 94 also effectively pin the bars 30 within the extension fixture 60 to resist the high axial tensile force generated across the components when the combined capacity assembly is used as a bar clamp. In an alternative embodiment, one side wall 84 of the extension fixture 60 may be threaded to accept the ends of the bolt 94 and thus preclude the need for nuts 96. Other devices may be used to generate the clamping force across the extension fixture 60 side walls 84 such as cam action clamps, additional threaded members, or other means as are readily known to those skilled in the art. Other means may be used to pin the bars within the extension fixture 60, such as pins inserted thru the fixture body, pins incorporated in the fixture body, pins formed as a portion of the fixture body, toothed or threaded surfaces which engage the upper or lower edges of the bar or other means as are readily known to those skilled in the art.

Figure 12:
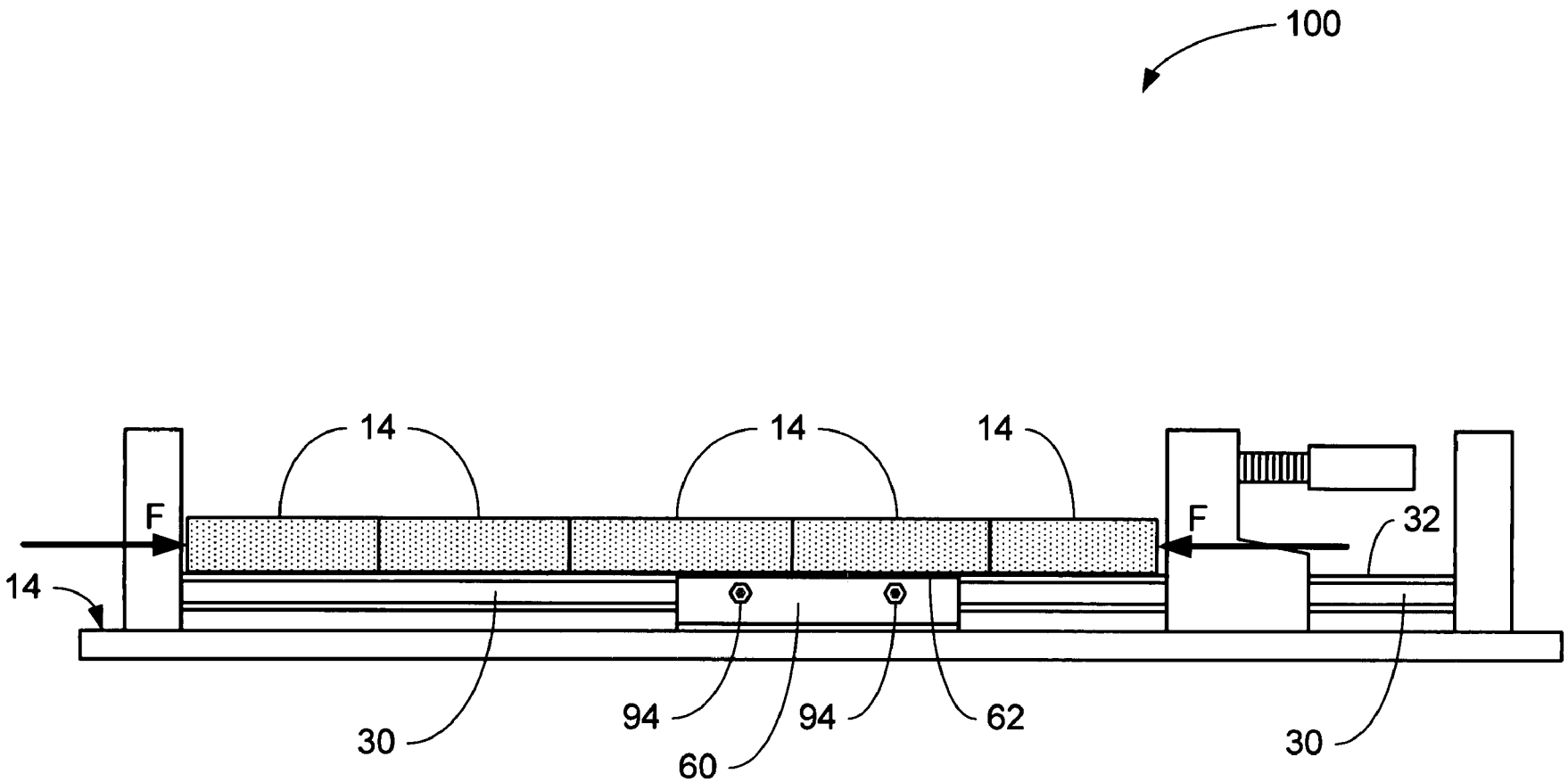
FIG. 12 depicts the combined capacity bar clamp assembly of FIG. 11 clamping a flat panel on a reference surface.

As depicted in FIG. 12, the assembly of the first bar clamp 10, the second bar clamp 20, and the extension fixture 60, now forms a combined capacity bar clamp assembly 100. The clamping capacity of the assembly 100 is approximately the combined capacity of the two individual bar clamps 10, 20 and the new combined capacity bar clamp may be used in exactly the same manner as a single exceptionally large capacity bar clamp. The clamping force upon the objects 14 is depicted in FIG. 12 by arrows "F." The bars 30 and extension fixture 60 are pressed or wedged into axial alignment with one another along the length the extension fixture by the clamping force provided by fasteners 94.

As further shown in FIG. 12, the upper edges 32 of each bar are in parallel alignment with one another, and will not shift from parallel alignment as the assembly 100 exerts a clamping force "F" on the objects 14. The upper edges 32 of the bar 30 in the combined capacity bar clamp assembly 100 may then be used as a straight reference edge during clamping operations as were the bars in the individual prior art bar clamps. As in the example of FIG. 3, the combined capacity bar clamp assembly 100 may be placed on a flat reference surface 16, and multiple boards 14 placed in the assembly for glue up and clamping. Since the upper surface 62 of the extension fixture 60 does not extend above the upper surface 32 of either bar 30, the straight reference edge of the combined bars is preserved continuously across the joint and objects to be clamped may be placed across the fixture on top of each bar.

While there has been shown a preferred embodiment of the present invention, it is to be understood that certain changes may be made in the forms and arrangement of the elements and steps of the method for shoreline reclamation without departing from the underlying spirit and scope of the invention.

What is claimed is:

1. An extension fixture for combining the clamping capacity of a first and a second bar clamp, the first and second bar clamps each having a fixed jaw, a movable jaw, and a primary bar, each movable jaw having a clamping means configured to provide a clamping force in the direction of the fixed jaw, each primary bar having an upper edge, a lower edge, a first distal end, a second distal end, and an I-beam cross sectional shape, each fixed jaw being affixed to the primary bar at the first distal end, wherein the movable jaw is removed from the first bar clamp, and the movable jaw orientation on the second bar clamp is reversed so that the clamping means is then configured to provide a clamping force away form the second fixed jaw, the extension fixture comprising:

a fixture body having a first end, a second end, an upper surface, a lower surface, a first side, and a second side;

the fixture body further comprising a channel in the upper surface thereof, the channel extending from the fixture first end to the fixture second end, the channel also having a complimentary cross sectional shape for receiving the first and the second primary bar cross sectional shape therein;

the channel in the fixture body having a first interior side surface, a second interior side surface, and a bottom surface;

the complimentary cross sectional shape of the fixture body having at least one hinge portion proximate to the channel bottom surface;

a first pin means for pinning the second distal end of the first primary bar within the fixture body;

a second pin means for pinning the second distal end of the second primary bar within the fixture body;

a clamping means for clamping the first and second primary bars within the fixture body; and wherein when the first and second primary bars are inserted into the fixture body, and the pin means are applied, the first and second pin means supports the clamping force between the fixed jaw of the first bar clamp and the movable jaw of the second bar clamp, and wherein as the clamping means is applied to the fixture body, the first interior side surface is biased towards the second interior side surface clamping the first and second primary bars within the fixture body, the deflection of the fixture body complimentary cross sectional shape occurring primarily in the at least one hinge portion, the clamping means holding the first primary bar and the second primary bar in substantially parallel alignment.

2. The extension fixture of claim 1, wherein the clamping means is a threaded connector inserted through the fixture body and a nut engaging the protruding end of the threaded connector and tightened.

3. The extension fixture of claim 1, wherein both the first and the second primary bars have a hole passing thru the primary bar proximate to the second distal end, the extension fixture further comprising:

a first hole passing through the fixture body proximate to the fixture body first end, the first hole extending from the channel to at least one of the fixture body first side or the fixture body second side;

a second hole passing through the fixture body proximate to the fixture body second end, the second hole extending from the channel to at least one of the fixture body first side or the fixture body second side; and wherein the first pin means is a pin passing through the first hole in the fixture body and through the hole in the first primary bar, and the second pin means is a pin passing through the second hole in the fixture body and through the hole in the second primary bar.

4. The extension fixture of claim 1, wherein both the first and the second primary bars have a hole passing thru the primary bar proximate to the second distal end, the extension fixture further comprising:

a first hole passing through the fixture body proximate to the fixture body first end, the first hole extending from the channel to at least one of the fixture body first side or the fixture body second side;

a second hole passing through the fixture body proximate to the fixture body second end, the second hole extending from the channel to at least one of the fixture body first side or the fixture body second side;

the channel in the fixture body having a first interior side surface, a second interior side surface, and a bottom surface;

the complimentary cross sectional shape of the fixture body having at least one hinge portion proximate to the channel bottom surface;

wherein the first pin means is a first threaded connector passing through the first hole in the fixture body and through the hole in the first primary bar, the second pin means is a second threaded connector passing through the second hole in the fixture body and through the hole in the second primary bar, and the clamping means is provided by the first and the second threaded connectors being tightened; and wherein as the clamping means is applied to the fixture body, the first interior side surface is biased towards the second interior side surface clamping the first and second primary bars within the fixture body, with the deflection of the fixture body complimentary cross sectional shape occurring primarily in the at least one hinge portion.

5. The extension fixture of claim 1, wherein the primary bar has a first side, and a second side, the primary bar cross sectional shape having a first concave portion between the upper edge and the lower edge on the first side of the primary bar, and an opposing second concave portion between the upper edge and the lower edge on the second side of the primary bar, the extension fixture further comprising:

the complimentary cross sectional shape of the channel in the fixture body having a complimentary first convex portion, and an opposing complimentary second convex portion; and wherein when the first and the second primary bar are positioned within the channel and the clamping means is applied to the fixture body, the first convex portion of the fixture body is received in the first concave portion of each primary bar, the second convex portion of the fixture body is received in the second concave portion of each primary bar, and the first primary bar, the second primary bar, and the extension fixture are clamped in substantially parallel alignment.

6. The extension fixture of claim 1, wherein the bar clamp fixed jaw further has a lower surface configured to support the primary bar upper edge an offset distance from a reference surface, and the bar clamp movable jaw further has a lower surface configured to support the primary bar upper edge the offset distance from the reference surface, and wherein;

the channel in the fixture body is displaced from the lower surface of the fixture body such that when the first and second primary bars are clamped within the fixture body, and the lower surface of the fixed jaw and the lower surface of the movable jaw are placed on a reference surface, the first and second primary bars upper edges are supported substantially parallel to the reference surface; and wherein the complimentary cross sectional shape of the channel in the fixture body is positioned a distance from the fixture body lower surface such that when the first and second primary bars are clamped within the fixture body, the fixture body lower surface is positioned either above the reference surface or adjacent the reference surface.

7. The extension fixture of claim 1, wherein the complimentary cross sectional shape of the channel in the fixture body is positioned a distance from the fixture body upper surface such that when the first and second primary bars are clamped within the fixture body, the upper edge of each primary bar extends above the upper surface of the fixture body.

8. An extension fixture for combining the clamping capacity of a first and a second bar clamp, the first and second bar clamps each having a fixed jaw, a movable jaw, and a primary bar, each movable jaw having a clamping means configured to provide a clamping force in the direction of the fixed jaw, each primary bar having an upper edge, a lower edge, a first distal end, a second distal end, and an I-beam cross sectional shape, each fixed jaw being affixed to the primary bar at the first distal end, the primary bar having a hole passing thru the primary bar proximate to the second distal end, the primary bar cross sectional shape having a first concave portion between the upper edge and the lower edge on the first side of the primary bar, and an opposing second concave portion between the upper edge and the lower edge on the second side of the primary bar, wherein the movable jaw is removed from the first bar clamp, and the movable jaw orientation on the second bar clamp is reversed so that the clamping means is then configured to provide a clamping force away from the second fixed jaw, the extension fixture comprising:

a fixture body having a first end, a second end, an upper surface, a lower surface, a first side, and a second side;

the fixture body further comprising a channel in the upper surface thereof, the channel extending from the fixture first end to the fixture second end, the channel also having a complimentary cross sectional shape having a complimentary first convex portion, and an opposing complimentary second convex portion, for receiving a first and a second primary bar cross section therein;

the channel in the fixture body having a first interior side surface, a second interior side surface, and a bottom surface; the complimentary cross sectional shape of the fixture body having at least one hinge portion proximate to the channel bottom surface;

a first hole passing through the fixture body proximate to the fixture body first end, the first hole extending from the channel to at least one of the fixture body first side or the fixture body second side;

a second hole passing through the fixture body proximate to the fixture body second end, the second hole extending from the channel to at least one of the fixture body first side or the fixture body second side;

wherein the first and second primary bars are inserted into the fixture body;

a first threaded connector passing through the first hole in the fixture body and through the hole in the first primary bar and tightened to pin and clamp the first primary bar in the fixture body;

a second threaded connector passing through the second hole in the fixture body and through the hole in the second primary bar, and tightened to pin and clamp the second primary bar in the fixture body;

and wherein as the first and second threaded connectors are tightened, the first convex portion of the fixture body is received in the first concave portion of each primary bar, the second convex portion of the fixture body is received in the second concave portion of each primary bar, the first primary bar, the second primary bar, and the extension fixture are then pinned to support the clamping force between the fixed jaw of the first bar clamp and the movable jaw of the second bar clamp, and the first primary bar, the second primary bar, and the extension fixture are clamped in substantially parallel alignment.

* * * * *